US010045583B2

(12) United States Patent
Sturgis

(10) Patent No.: US 10,045,583 B2
(45) Date of Patent: Aug. 14, 2018

(54) TOE PROTECTION INSERT FOR AN ATHLETIC SHOE

(71) Applicant: Mark Sturgis, Rehoboth Beach, DE (US)

(72) Inventor: Mark Sturgis, Rehoboth Beach, DE (US)

( * ) Notice: Subject to any disclaimer, the term of this patent is extended or adjusted under 35 U.S.C. 154(b) by 80 days.

(21) Appl. No.: 15/233,880

(22) Filed: Aug. 10, 2016

(65) Prior Publication Data

US 2016/0345659 A1 Dec. 1, 2016

Related U.S. Application Data

(63) Continuation-in-part of application No. 14/542,975, filed on Nov. 17, 2014, now abandoned.

(60) Provisional application No. 61/905,107, filed on Nov. 15, 2013.

(51) Int. Cl.

| | |
|---|---|
| ***A43B 7/14*** | (2006.01) |
| ***A43B 17/03*** | (2006.01) |
| ***A43B 5/00*** | (2006.01) |
| ***A43B 13/40*** | (2006.01) |
| ***A43B 7/26*** | (2006.01) |
| ***A43B 17/16*** | (2006.01) |

(52) U.S. Cl.

CPC ..... *A43B 7/14* (2013.01); *A43B 5/00* (2013.01); *A43B 7/141* (2013.01); *A43B 7/142* (2013.01); *A43B 7/26* (2013.01); *A43B 13/40* (2013.01); *A43B 17/03* (2013.01); *A43B 17/16* (2013.01)

(58) Field of Classification Search

CPC .. A43B 7/14; A43B 7/26; A43B 13/40; A43B 5/00; A43B 3/10; A43B 3/12

See application file for complete search history.

(56) References Cited

U.S. PATENT DOCUMENTS

| | | | | |
|---|---|---|---|---|
| 1,012,245 | A | 4/1911 | Chase | |
| 1,167,019 | A * | 1/1916 | Reed | A61F 5/019 36/11.5 |
| 1,402,375 | A * | 1/1922 | Parisi | A43B 7/26 36/94 |
| 4,745,927 | A | 5/1988 | Brock | |
| 6,782,640 | B2 | 8/2004 | Westin | |
| 8,191,285 | B2 | 6/2012 | Perron, Jr. | |
| 2003/0074718 | A1* | 4/2003 | English | A41B 11/004 2/239 |
| 2009/0300944 | A1 | 12/2009 | Miller | |
| 2011/0016745 | A1 | 1/2011 | Hammerbeck | |
| 2012/0272548 | A1 | 11/2012 | Downard | |
| 2012/0302933 | A1 | 11/2012 | Ostergard | |
| 2013/0239435 | A1 | 9/2013 | McDowell | |

* cited by examiner

*Primary Examiner* — Shaun R Hurley
*Assistant Examiner* — Bao-Thieu L Nguyen

(57) ABSTRACT

A toe protection insert for an athletic shoe surrounds the big toe and laces up to protect the toe from injury. The laces of the insert are designed to pull through the shoelace holes of the athletic shoe, to enable the user to position the toe as desired and elevate the toe above the shoe sole of an athletic shoe. The insert may include only a toe sleeve which wraps around the hallux toe or may also provide an insert sole upon which the toe sleeve is attached.

1 Claim, 2 Drawing Sheets

FIG. 1
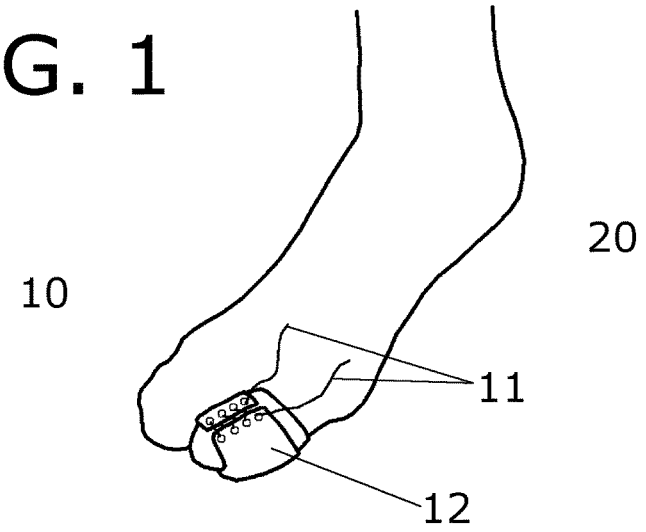
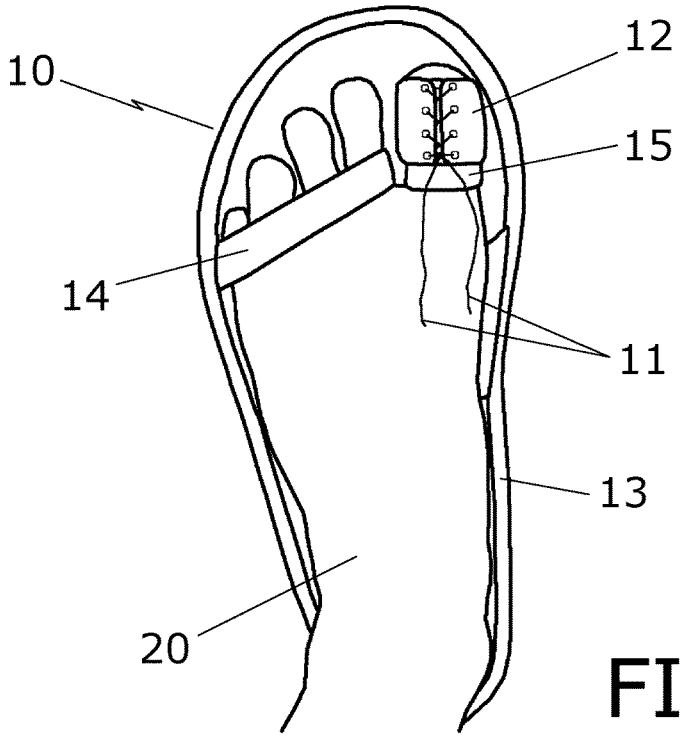
FIG. 2

TOE PROTECTION INSERT FOR AN ATHLETIC SHOE

CROSS-REFERENCE TO RELATED APPLICATIONS

This application is a continuation of previously filed Ser. No. 14/542,975 filed Nov. 17, 2014 which claims the benefit of U.S. Provisional Application No. 61/905,107, filed Nov. 15, 2013, which are hereby incorporated by reference.

STATEMENT REGARDING FEDERALLY SPONSORED RESEARCH OR DEVELOPMENT

Not Applicable

PARTIES TO A JOINT RESEARCH AGREEMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The invention relates generally to sports equipment and accessories and in particular to a toe protection insert for an athletic shoe. All athletes are well aware that protecting their feet and toes, both from new injuries and aggravation of existing injuries, is essential for mobility and staying competitive. But with the proliferation of Astroturf™ and similar artificial surfaces, the injury known as "turf toe" has unfortunately become widespread among athletes. Applying athletic tape before training and competition, and removing it afterward, has provided some degree of protection but it often must be fixed multiple times during the sporting activity and is therefore time-consuming and inconvenient. A toe protection insert for athletic shoes would help to resolve this problem. In particular an insert that surrounds the big toe and laces up to protect the toe from injury would be useful. The laces of the insert are designed to pull through the shoelace holes of the athletic shoe, to enable the user to position the toe as desired. Specialized inserts may also be provided, which separate the big toe from the other toes.

SUMMARY OF THE INVENTION

Accordingly, the invention is directed to a toe protection insert for an athletic shoe. The insert surrounds the big toe and laces up to protect the toe from injury. The laces of the insert are designed to pull through the shoelace holes of the athletic shoe, to enable the user to position the toe as desired. Specialized socks are also provided, which separate the big toe from the other toes.

Additional features and advantages of the invention will be set forth in the description which follows, and will be apparent from the description, or may be learned by practice of the invention. The foregoing general description and the following detailed description are exemplary and explanatory and are intended to provide further explanation of the invention.

BRIEF DESCRIPTION OF THE DRAWINGS

The accompanying drawings are included to provide a further understanding of the invention and are incorporated into and constitute a part of the specification. They illustrate one embodiment of the invention and, together with the description, serve to explain the principles of the invention.

FIG. 1 shows a perspective view of the first exemplary embodiment, displaying the insert 10, the laces 11, and the toe sleeve 12, without the insert sole 13.

FIG. 2 shows a top view of the second exemplary embodiment, displaying the insert 10, the laces 11, the toe sleeve 12, the insert sole 13, the toe strap 14, and the big toe strap 15.

DETAILED DESCRIPTION OF THE INVENTION

Figure 3:
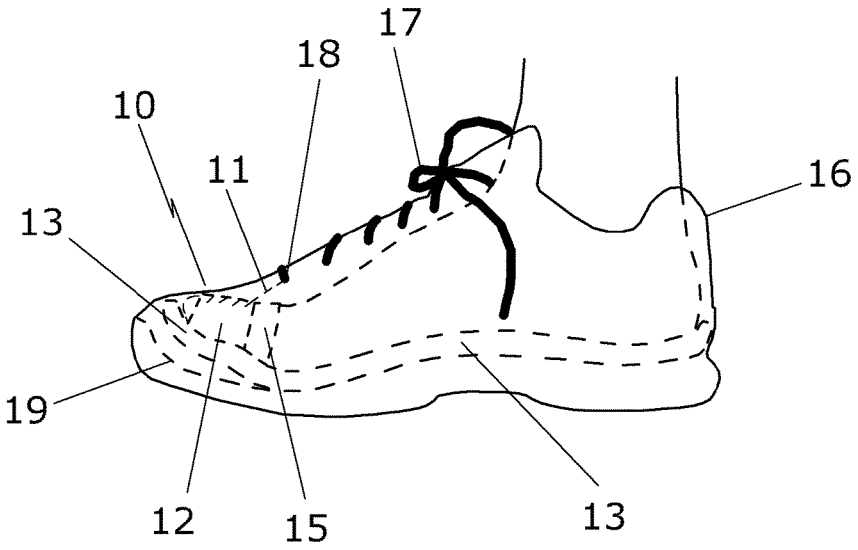
FIG. 3 shows a side view of the second exemplary embodiment being worn with a shoe 16, displaying the insert 10, the laces 11, the toe sleeve 12, the insert sole 13, the big toe strap 15, the shoe 16, the shoe laces 17, the shoe lace holes 18, and the shoe sole 19.

Referring now to the invention in more detail, the invention is directed to a toe protection insert 10 for an athletic shoe 16. The insert 10 surrounds the big toe in two parts and laces up to allow adjustable tension on the toe. Tension on the laces 11 will protect the toe from injury by lifting the toe away from the shoe sole 19. The laces 11 of the insert 10 are intended to be pulled through the shoelace holes 18 of the athletic shoe 16, according to a method of use, to enable the user to position the hallux toe 21 of the user's foot 20 as desired by tightening the laces 11 to a desired tension, threading the laces 11 through the shoelace holes 18 of the athletic shoe 16, adjusting the position of the toe to a desired location, and tying the laces 11 outside of the athletic shoe. For this reason, the laces 11 are preferably long relative to the length of the insert 10 as shown. Specialized socks may also be provided, which separate the big toe from the other toes.

The first exemplary embodiment features an insert 10 which is generally free from any other structure. The insert includes only a toe sleeve 12. The toe sleeve 12, wraps around the big toe and provides laces 11. The laces 11 are long in relation to the toe so that they can be fed through the shoe lace holes 18 of the athletic shoe 16. As described above, the laces 11 can be tightened and adjusted to position the big toe in a supported position. The toe sleeve 12 and laces 11 lift the big toe off the shoe sole 19 so that the big toe is not touching the shoe sole 19. This is different from the prior art which tends to hold the hallux toe 21 down to the shoe sole 19 rather than elevating it.

The second exemplary embodiment includes a generally footprint shaped insert sole 13. The insert sole 13 provides a toe strap 14 in a "lesser toe position" which is generally where the lesser toes of the foot 20 are located when a user wears the insert 10. The insert sole 13 further provides a big toe strap 15 in a "big toe position" which is generally where the big toe of the foot 20 are located when a user wears the insert 10. The toe strap 14 and big toe strap 15 separate the big toe from the rest of the lesser toes when the insert 10 is worn. The toe sleeve 12 is affixed to the big toe strap 15 and insert sole 13. The toe sleeve 12, and attached insert sole 13, function in much the same way as the toe sleeve 12 with laces 11 of the first exemplary embodiment in that the laces 11 are fed through the shoe lace holes 18 and are adjusted and tightened to raise the shoe sleeve 12 and insert sole 12 away from the shoe sole 19.

According to well-known methods of producing shoe inserts the insert 10 is preferably manufactured from a semi-rigid, durable material such as plastic. The insert 10 is sufficiently flexible to enable the ball of the user's foot to bend comfortably without significant resistance. In the second exemplary embodiment, a fabric sleeve covers the insert sole 13, providing a thin layer of shock-absorbing foam padding for the user's comfort, and is easily removed and machine washable. The insert 10 is preferably available in a plurality of colors to match professional, college, and high school sports colors. In addition, a cushion bubble layer is provided throughout the insert sole 13 of the insert 10 as a shock absorber; the cushion bubble layer comprises a pattern of circular bubble made of a flexible membrane and filled with air or other compressible fluid.

The insert 10, the toe sleeve 12, the insert sole 13, the toe strap 14, and the big toe strap 15 are preferably manufactured from a semi-rigid, durable material such as plastic. The laces 11 are preferably manufactured from a flexible, durable material with substantial strength, such as nylon. The fabric sleeve over the insert sole 13 is preferably manufactured from a flexible, durable fabric which is machine washable, such as elasticized cotton, and features a thin layer of padding which is preferably manufactured from a flexible, durable material such as foam rubber. The cushion bubble layer is preferably made of a flexible plastic membrane material. Embodiments wherein the components are manufactured from perflorinated compounds are also contemplated. Components, component sizes, and materials listed above are preferable, but artisans will recognize that alternate components and materials could be selected without altering the scope of the invention.

While the foregoing written description of the invention enables one of ordinary skill to make and use what is presently considered to be the best mode thereof, those of ordinary skill in the art will understand and appreciate the existence of variations, combinations, and equivalents of the specific embodiment, method, and examples herein. The invention should, therefore, not be limited by the above described embodiment, method, and examples, but by all embodiments and methods within the scope and spirit of the invention.

I claim:

1. A method of using a toe protection insert for an athletic shoe, the toe protection insert comprising:

a toe sleeve;

said toe sleeve being sized and shaped to fully wrap around a hallux toe;

said toe sleeve further providing laces;

said laces being configured to be long and able to tighten the toe sleeve around the hallux toe;

said laces being configured to feed through a shoe lace hole of the athletic shoe and be adjustably tensioned such that the toe sleeve elevates the hallux toe above a shoe sole of the athletic shoe;

the method comprising:

wrapping the toe sleeve around the hallux toe;

tightening the laces to securely fasten the toe sleeve around the hallux toe;

feeding the laces through the shoe lace hole of the athletic shoe;

positioning the hallux toe in a selective position;

tightening the laces through the shoe lace hole such that the hallux toe is elevated above the shoe sole of the athletic shoe; and tying the laces to secure the hallux toe in the elevated position.

* * * * *